United States Patent [19]

Barton

[11] Patent Number: 4,635,291

[45] Date of Patent: Jan. 6, 1987

[54] FOOD POUCH WITH INTEGRAL COLLAR

[76] Inventor: Lewis Barton, 87 Chelsea Rd., Garden City, N.Y. 11530

[21] Appl. No.: 656,608

[22] Filed: Oct. 1, 1984

[51] Int. Cl.[4] ..... B65D 33/14

[52] U.S. Cl. ..... 383/24; 206/806; 229/52 AL; 383/6; 383/116

[58] Field of Search ..... 383/6, 7, 21, 26, 220, 383/23, 24, 12, 109, 116; 206/806, 484; 229/52 AL

[56] References Cited

U.S. PATENT DOCUMENTS

| | | | |
|---|---|---|---|
| 1,603,362 | 10/1926 | Stewart . | |
| 2,146,308 | 2/1939 | Maxfield . | |
| 2,340,719 | 2/1944 | Walter . | |
| 2,878,849 | 3/1959 | Lingenfeller . | |
| 3,149,431 | 9/1964 | Blish . | |
| 3,268,151 | 8/1966 | Soto . | |
| 3,285,499 | 11/1966 | Repko | 383/62 |
| 3,348,760 | 10/1967 | Hinsken et al. . | |
| 3,462,069 | 8/1969 | Suominen . | |
| 3,514,033 | 5/1970 | Goodwin | 383/21 X |
| 3,520,470 | 7/1970 | Korn et al. | 383/7 |
| 3,732,661 | 5/1973 | Goldberger et al. | 383/22 X |
| 3,941,306 | 3/1976 | Weikert . | |
| 4,010,299 | 3/1977 | Hershey, Jr. et al. . | |
| 4,044,890 | 8/1977 | Kramming . | |
| 4,058,207 | 11/1977 | Koltz . | |
| 4,096,897 | 6/1978 | Cammarata, III . | |
| 4,201,299 | 5/1980 | Bumgarner et al. . | |
| 4,208,819 | 6/1980 | Jones et al. . | |
| 4,309,835 | 1/1982 | Naeve . | |
| 4,353,460 | 10/1982 | Kahn . | |
| 4,401,213 | 8/1983 | Lerner . | |
| 4,516,267 | 5/1985 | Kent et al. | 383/22 |

FOREIGN PATENT DOCUMENTS

| | | | |
|---|---|---|---|
| 1222238 | 5/1963 | Fed. Rep. of Germany | 383/6 |
| 3205340 | 8/1983 | Fed. Rep. of Germany | 383/6 |
| 2228681 | 6/1974 | France | 383/7 |

*Primary Examiner*—William Price
*Assistant Examiner*—Bryon Gehman
*Attorney, Agent, or Firm*—Scully, Scott, Murphy and Presser

[57] ABSTRACT

A flexible pouch which includes a sealed product-containing pocket, and which pouch also incorporates integral collar-forming structure adapted to enable the pouch to be suspended from an object, such as a bottle neck or the like.

6 Claims, 3 Drawing Figures

FOOD POUCH WITH INTEGRAL COLLAR

BACKGROUND OF THE INVENTION

1. Field of the Invention

The present invention relates to a method of forming a flexible pouch which includes a sealed product-containing pocket, and which pouch also incorporate integral collar-forming structure adapted to enable the pouch to be suspended from an object, such as a bottle neck or the like. More particularly, the invention provides for a method of continuously forming a sequence of pouches, wherein the pouches are produced through successive process steps from two superimposed flexible sheet material webs having pocket-forming seals and collar structure formed therein. Additionally, the invention also provides for the formation of flexible pouches incorporating sealed product-containing pockets and integral collar-forming structure which will enable each pouch to be suspended from an object, and in which the pouches are formed in accordance with the inventive method.

In recent years, packages or pouches which contain article-receiving or product-containing pockets, and particularly pouches formed of flexible materials have achieved widespread and diverse commercial and industrial applications. Frequently, such flexible pouches or packages are constituted of thermoplastic sheet material, which when required, may be foil-lined in order to provide liquid-impervious sealed pockets for liquid products. For example, among such widely-employed packages are flexible pouches for single-servings condiments, such as ketchup, mustard, relish, granulated or powdered sugar or the like amongst others; or flexible package structure having pockets which are open at one end to provide for the insertion therein of folded newspapers, magazines or the like. The packages or pouches if desired, may also be provided with attached or integral structure enabling them to be suspended, for instance on display hooks, doorknobs or container neck portions, wherein in the latter case they may be in the form of socalled sample packages or premiums.

Although numerous kinds of flexible pouches or packages which incorporate product-containing pockets have been developed in industry, their structures and methods of production thereof are generally quite complex and often necessitate the utilization of diverse and expensive manufacturing equipment, while also necessitating the employment of production steps which do not readily lend themselves to the simple and continuous "in-line" manufacture of such kinds of flexible packages or pouches. Moreover, quite frequently the formation of the packages and the filling of their pockets with product necessitates the use of adhesives, and also the trimming or cutting of packaging material, and the punching out of collar openings, thereby material, and the punching out of collar openings, thereby considerably increasing manufacturing and material costs, and sending them somewhat uneconomical for mass production techniques.

2. Discussion of the Prior art

Thus, Beck U.S. Pat. No. 3,616,991 discloses a flexible package constituted of two superimposed plastic material sheets, in which a pocket for receiving a product, such a flat article, is formed by four seals encompassing the surface area defined by the article. One of the plastic sheet portions extend beyond the area of the pocket to define a flap portion into which there is punched a cutout to facilitate the package to be suspended from a suitable display hook or the like. The flexible packages may be formed in series, with a severing or weakening line being formed to extend through the transverse seal between the article-containing pocket of each sequential package to allow for tearing off into individual separated packages. Although this provides for a relatively simple flexible plastic film or sheet package construction incorporating an article or product-receiving pocket and a projecting flap portion enabling suspension of the entire package from an object, the construction thereof requires the trimming of material along the edges of the package, thereby resulting in increased material costs, while necessitating the punching of cutouts into the flap to provide the hanger portion, with the concomitant requirement for separate punching dies. This will also increse the expendicutres for different types of manufacturing apparatus and the manufacturing procedure expensive.

Bumgarner, et al. U.S. Pat. No. 4,201,299 discloses a bag which is constituted of a plastic sheet material, such as polyethylene film, in which there is formed an open pocket for the insertion of a folded newspaper or the like, and in which a collar portion with a cutout is provided at one end for suspension from a doorknob, hook or the like. In this instance, the manufacture of the bag necessitates the folding and subsequent adherence of webs of plastic sheet material and the seprate attachment thereto of the collar or neck portion. This renders the entire bag manufacturing process complex and expensive, and does not readily lend itself to the formation of pouches having sealed product-containing pockets in a continuous "in-line" operation, eliminating any requirement for special machinery or equipment and with practically no waste material as in the present invention.

Maxfield U.S. Pat. No. 2,146,308 discloses the continuous or sequential production of product-containing packages, in which a continuous web of a plastic film sheet material is folded into a tubular configuration about a tubular filler while being conducted in a downward moving path, and wherein a seal is formed along one longitudinal edge by the application of a second web, and a subsequent transverse seal is formed to allow for the formation of a pocket which is open at the upper end thereof, and into which product is then filled by the filler. Thereby, as the continuous web is moved down, the formation of subsequent transverse seals produce a series of individual, interconnected sealed product-containing pouches which may thereafter be severed through the transverse seals so as to form separate pouches. In this instance, in order to allow for the provision of eyelets which will facilitate the pouches to be suspended from a display hook or the like, the longitudinally sealed edge provided by the second folded over web material has the eyelets punched therethrough, and reinforcing members inserted for enabling the suspension of each pouch. This procedure entails an extremely complex manufacturing operation requiring the use of punching dies, and the rings or grommets in the eyelets. Consequently, both as to method and structure, Maxfield is not readily adapted to provide economically produced product-containing flexible pouches of the type contemplated by the present invention.

Jones, et al. U.S. Pat. No. 4,208,819 discloses a recipe booklet which incorporates a flap member of plastic material having an aperture punched therein to form a collar structure for suspending the booklet from a container, such as from the neck of a bottle. In this instance, the overall structure is formed from individual components which must be folded, the flap member adhered thereto and the suspending aperture or content punched therethrough in order to provide the bottle neck-engaging collar structure. Consequently, this necessitates equipment such as punching dies and adhesive applicators, thereby rendering the method of manufacture cumbersome and expensive.

Johnston, et al. U.S. Pat. No. 4,199,062 discloses a bag or container of a flexible material for dispensing a liquid, having extensions are formed at opposite ends of the container to allow for the insertion of dispensing tubes at one end and for the formation of an aperture at the opposite end for suspending the bag in a vertical orientation from a hook or suitable support. In this case, the formation of the suspending bag portion and the other extensions requires the use of complex punching and forming equipment which does not readily lend itself to the simple "in-line" formation of the product-containing flexible pouches by a manufacturing method as contemplated by the present invention.

Similarly, Cammarata, III, U.S. Pat. No. 4,096,897 discloses a liquid-containing pouch of a flexible and collapsible material in which an extension at one end of the pouch includes an openign for suspending the pouch from a hook or suitable support. As in Johnston, et al., the construction of a flexible pouch of that type is of a relatively complex nature requiring the use of different types of apparatus, such as cutting, sealing and punching equipment, thereby rendering the manufacturing costs and material consumption extremely uneonocmical, particularly when applied to a simple type of flexible pouch which is provided for disposable or single-use purposes as contemplated by the present invention.

SUMMARY OF THE INVENTION

In order to overcome the limitation and economic drawbacks encountered in the manufacture of flexible pouches of the type described hereinabove, the present invention contemplates a method in which two continuous webs or sheets of a liquid-impervious flexible material, such as polyethylene film, which depending upon intended use may each be constituted of a laminate, for example with a suitable foil lining, and wherein the film webs are continuously conveyed in a direction extending in parallel with the longitudinal web axis, preferably in a vertical downwardly path of travel. Prior to the superposition the sheets or webs, formed in at least one of the sheets a pair of parallel spaced weakening or severing lines spaced inwardly from and coextensive with one edge. A pair of parallel spaced continuous side seals, are formed in the webs to seal the letter extending in parallel with the longitudinal axes of the film sheets therein, one of the seals being provided to extend along the other longitudinal web edge, whereas the second continuous seal is formed in proximity with the inwardly located weakening line. In effect, the two weakening or severing lines are positioned externally of and in parallel with the two longitudinal side seals in the webs. At predetermined intervals, determined by the advancing speed of the superimposed and sealed-together webs, there is imparted a transverse or cross-seal to the webs extending over the entire width thereof, which will form a sealed pocket encompassing the product defined by the area bounded by the side seals and transverse seals and in which the externally located weakening or severing lines, which may be continuous or discontinuous slits or perforations, may be deflected out of the plane of the pouch to sever the webs therebetween in order to form a collar structure enabling the pouch to be suspended from a container, such as a bottle neck.

Accordingly, it is an object of the present invention to provide a method for the forming of pouches including collar structure for suspending the pouches from an object.

A more specific object of the present invention resides in the provision of a method as described hereinabove in which flexible pouches including sealed product-containing pockets and collar structure for suspending the pouches from an object, such as a bottle neck, are formed from two continuous, superimposed webs of a flexible materials, and slitted, sealed and filled with product in a continuous manufacturing sequence.

BRIEF DESCRIPTION OF THE DRAWINGS

Still another object of the present invention is to provide flexible pouches incorporating sealed product-containing pockets and collar structure for suspending the pouches from an object, wherein the pouches are produced through the inventive method.

Reference may now be had to the following detailed description of a preferred embodiment of the invention, taken in conjunction with the accompanying drawings; in which:

FIG. 1 illustrates the upper portion of a container, such as the neck of a bottle, having a pouch pursuant to the present invention suspended thereon, in order to constitute a premium, sample or the like;

DETAILED DESCRIPTION

Figure 1:
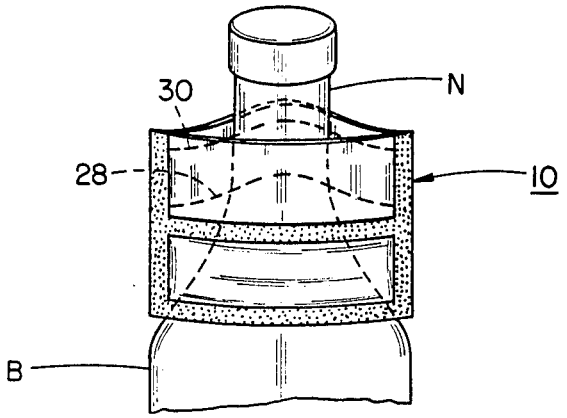

Referring now to FIG. 1 of the drawings, there is illustrated the upper portion of a bottle B having a narrowing and elongated neck portion N on which there may be suspended, in a "papoose-like" manner, the inventive flexible pouch 10, as described in detail hereinbelow. The pouch 10, may be provided as a so-called premium or sample packet of a particular product which is to be commercially promoted concurrent with the retail sale to a consumer of the product contained in the bottle B.

Figure 2:
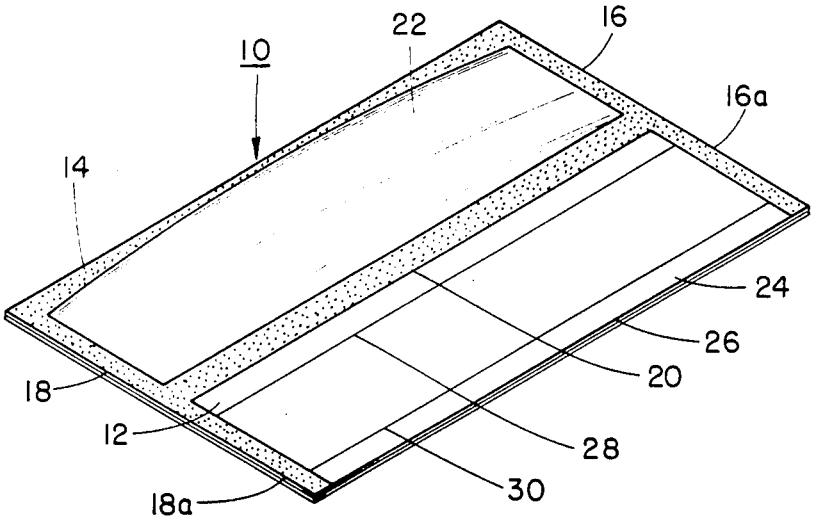
FIG. 2 illustrates a perspective view of the flexible pouch of FIG. 1, shown on an enlarged scale, which includes a product-receiving pocket and integral collar-like structure externally of the pocket to enable the pouch to be suspended from an object.

As illustrated in more specific detail in FIG. 2 of the drawings, the pouch 10 is constituted from superimposed sheets or continuous webs of flexible liquid-impervious material 12 which, depending upon the particular intended use, may be either plastic sheets such as polyethylene film, or a laminate constituted of plastic film with an inner liner of a suitable foil material adhered thereto.

In this instance, the inventive flexible pouch 10 is of a flat generally rectangular or parallelepiped configuration having the superimposed webs 12 sealed to each other along three edges, with a first and second side seals 14 and to, and upper and lower parallel spaced transverse seals 16 and 18. The second side seal 20 extends in parallel with the side seal 14 but is spaced inwardly from the opposite edge of the pouch so as to form a sealed pocket construction 22 containing a suitable product; for example, either in liquid or granular form such as mustard, ketchup, relish, a salad dressing, or granulated sugar and the like. The pocket structure 22 is defined by the area between the webs 12 bounded by the seals 14, 20 and 16, 18. The flexible pouch, and particularly the pocket structure 22 may be dimensioned so as to provide a pocket volume containing a suitable so-called "single serving" of a specific product.

The surface area 24 of the pouch 10 externally of the pocket, is defined by the superimposed film layers or webs 12 and bounded by the side seal 20, the unsealed edge 26 between the webs 12, and the transverse seal portions 16A and 18A of the seals 16 and 18, and which is adapted to form the inventive collar structure as detailed hereinbelow.

Formed in at least one of the superimposed webs 12 within the area 24, and extending in parallel with and between the unsealed edge 26 and the side seal 20, are a pair of parallel spaced severing or weakening lines 28 and 30, with the weakening line 28 being spaced proximate the side seal 20, and the weakening line 30 being spaced proximate the unsealed edge 26. The weakening line 28 and 30 may be formed of either continuous slits extending through one sheet 12, from the discontinuous slits or perforations. Alternatively, the weakening lines 28 and 30 may also be formed so as to extend through both of the superimposed sheets 12, and with the opposite ends of the weakening lines 28 and 30 being sealed by the respective seal portions 16A and 18A in the webs 12.

Accordingly, when it is desired to suspend a pouch 10 from the neck N of a bottle or container B, as illustrated in FIG. 1 of the drawings, it is merely necessary to sever the portion of the web material along the weakening lines 28 and 30 between the seals 16A and 18A, and to deflect the resultant material strip out of the plane of the pouch, thereby forming a loop or collar-like opening by the strip of material and the material between the weakening line 30 and unsealed edge 26 and the material between the weakening line 28 and side seal 20, and to slide the pouch over the neck N of the bottle B by means of this opening, thereby suspending the entire pouch 10 from the bottle neck.

The outer surfaces of the pouch 10 may be embossed or imprinted with suitable indicia and advertising legends representative of the particular product which is contained in the pocket 22, so as to constitute a suitable advertising sample or premium for a new product.

The method of forming each flexible pouch 10 is now described as follows, particular reference being had to the diagrammatic representation in FIG. 3 of the drawings.

First and second webs of a flexible sheet material 12, which webs are substantially identical in width and composition, are conveyed from suitable supply rolls (not shown) in the direction of arrows A (machine direction) so as to be in substantially superimposed relationship with each other upon reaching Station 1. The material of the webs 12 may be suitable thermoplastic film, such as polyethylene film, and dependent upon intended use, the surfaces of the film sheets 12 facing each other, which will constitute the interior of the pouch, may be provided or adhered with a suitable liner, such as a gas barrier-forming or liquid-impervious foil material. The surfaces of each of the webs 12 adapted to form the outer surfaces of the pouch may be previously imprinted or embossed with suitable indicia and advertising legends, as is well known in the packaging art.

Prior to the superimposed webs 12 reaching Station 1, at least one of the sheets 12 may be provided with a pair of parallel spaced severing or weakening lines 28, 30 in the machine direction which are offset towards the one edge 26. The weakening lines 28, 30 may be either continuous slits, or, alternatively, discontinuous slits, perforations or indentations rendering them frangible relative to the strength of the material 12 so as to constitute tear lines. Alternatively, if desired, rather than being provided in only one of the webs 12, the weakening lines 28, 30 may be deep enough so as to extend through both of the superimposed webs 12.

At Station 2 the superimposed webs 12 have continuous side seals 14 and 20 imparted thereto, wherein the side seal 14 extends along the longitudinal edge of the superimposed webs 12 opposite the unsealed edge 26, so as to seal the webs together along that edge, whereas side seal 20 extends in close parallel relationship with the weakening line 28 along the side towards the seal 14. The seals may be constituted of heat seals, as known the technology.

When the sealed together webs 12 reach Station 3, there is imparted a transverse or cross seal 32, such as a heat seal, extending across the entire width of the webs 12, thereby forming an upwardly opening pocket between the webs 12 which is bounded by the side seals 14, 20 and the cross seal 32, with the cross seal 32 concurrently sealing the ends of the weakening lines 28 and 30 of the superimposed webs at that location. Concurrently, a suitable stationary filler arrangement 34 is adapted to introduce a predetermined quantity of a product P into the upwardly opening pocket.

Thereupon, upon the further downward advancement, of the webs 12 in the machine direction (arrow A) through a distance L defining the intended length of the pouch in that direction, a subsequent transverse or cross seal 32 is imparted to the webs at Station 3, this will then produce a completely sealed pocket 22 enclosing the product therein below the station. At that time, the following or upstream located, upwardly opening pocket, bounded by seals 14, 20 and the newly formed seal 32 has product introduced therein by the filler arrangement 34.

As the downstream completed pouch is advanced to Station 5, or even at Station 4, the cross seal 32 is severed along a central line 36 thereof so as to separate the seal into the previously referred to seal 18 and 16. The severing line 36 may be either a continuous through cut or slit separating the attached pouches 10 into individual pouches, as illustrated at the lower end of FIG. 3 or alternatively, may be in the form of a weakening line such as a discontinuous slit, perforations or a weakening of the web material so as to allow for the formation of series of attached pouches 10 which can be readily separated by tearing along the severing or weakening line 36.

Figure 3:
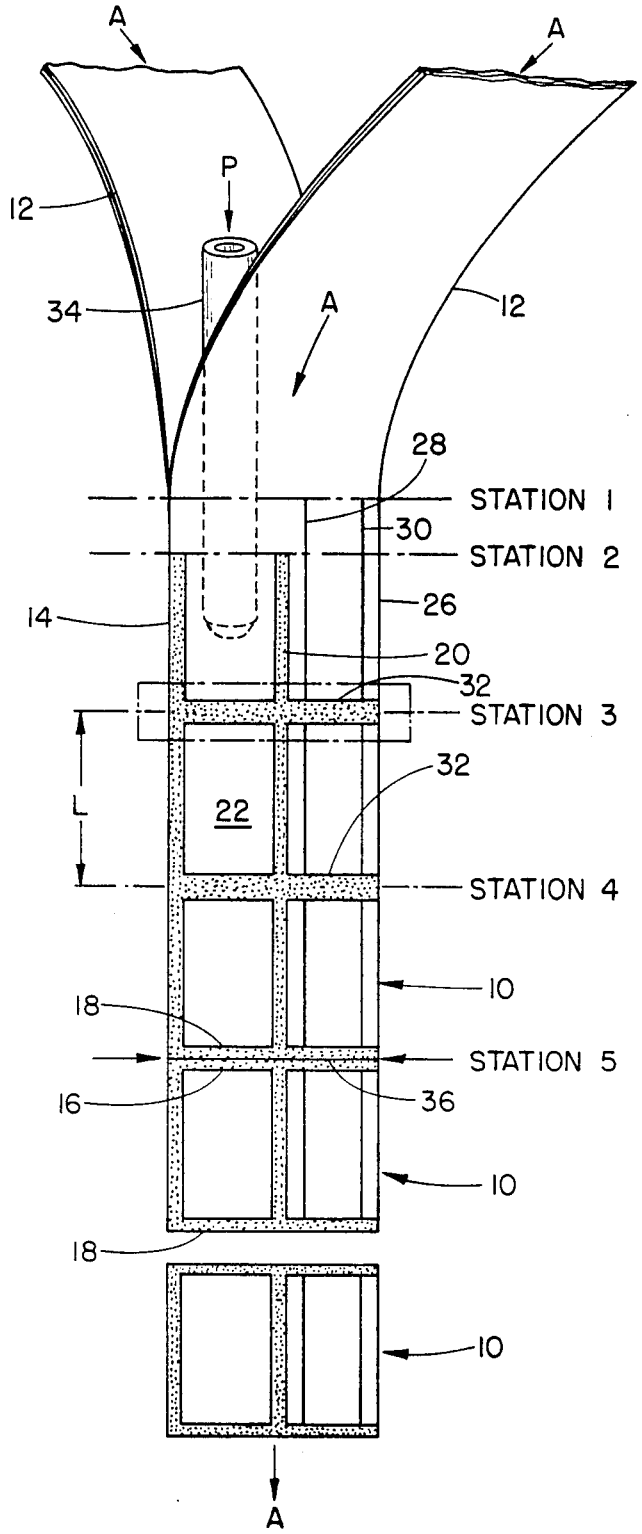
FIG. 3 illustrates, in a generally diagrammatic representation, the method of manufacturing each of the inventive pouches.

Although FIG. 3 illustrates the method of producing pouches along a single production line, it will be readily apparent to one skilled in the art that the webs may be sufficiently wide, and the apparatus for implementing the method, as to allow for the formation of a plurality or multiplicity of lines of pouches 10 in concurrent and side by side relationship.

From the foregoing, it becomes readily apparent that the inventive method requires no separate punching apparatus for providing the cutouts forming the suspending collar, and consequently there is no waste material produced during the formation of the pouches, while the production thereof may be effected continuously in an "in-line" operation to provide for the efficient and economical manufacture thereof.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A flexible pouch having a generally parallelpiped configuration and including a sealed product-containing pocket for a viscous flowable food product and integral collar-forming structure externally of said pocket enabling said pouch to be suspended from an object, said pouch comprising two sheets each constituted of a liquid-impervious laminated flexible material including a plastic film web arranged to provide two superimposed facing plastic film webs, seals extending about three edges of said pouch for adhering said plastic film webs of said laminated material to each other, a further seal extending in parallel with the unsealed edge and being offset relative to said edge, said sealed pocket being located intermediate said seals, and a surface area of said pouch being located intermediate said pocket and the unsealed edge; a pair of parallel space continuous slits extending through at least one of said sheets of laminated material in said surface area and extending in parallel with the unsealed edge whereby separation of the laminated material sheets along said continuous slits provides a loop-like strip constituting sid collar structure.

2. A flexible pouch as claimed in claim 1, wherein said weakening lines are continuous slits.

3. A flexible pouch as claimed in claim 1, wherein said weakening lines extend through both film webs.

4. A flexible pouch as claimed in claim 1, wherein said seals seal the ends of said weakening lines.

5. A flexible pouch as claimed in claim 1, wherein a plurality of said pouches are formed in interconnected series from continuous film webs; and weakening lines being formed intermediate said pouches to facilitate separation thereof into individual pouches.

6. A flexible pouch as claimed in claim 1, wherein said seals are heat seals.

* * * * *